US008696203B2

(12) United States Patent
Rednour et al.

(10) Patent No.: US 8,696,203 B2
(45) Date of Patent: Apr. 15, 2014

(54) GIFT BAGS WITH REMOVABLE, CONFIGURABLE AND WEARABLE PARTS

(75) Inventors: Karen Rednour, Strongsville, OH (US); Dan Kopsak, Lakewood, OH (US); Suzanne M. Lahr Yoder, Columbia Station, OH (US)

(73) Assignee: American Greetings Corpoation, Cleveland, OH (US)

( * ) Notice: Subject to any disclaimer, the term of this patent is extended or adjusted under 35 U.S.C. 154(b) by 786 days.

(21) Appl. No.: 12/250,662

(22) Filed: Oct. 14, 2008

(65) Prior Publication Data

US 2010/0092109 A1 Apr. 15, 2010

(51) Int. Cl.
*B65D 30/10* (2006.01)
*B65D 33/00* (2006.01)

(52) U.S. Cl.
USPC ..... 383/111; 383/209; 206/458

(58) Field of Classification Search
CPC ... B65D 81/363; B65D 81/361; B65D 33/004
USPC ..... 383/6, 105, 111, 127, 209; 206/457, 206/495, 831, 223, 458; 229/116.1, 116.5, 229/118, 922, 92.8; 446/73, 74, 79, 80
See application file for complete search history.

(56) References Cited

U.S. PATENT DOCUMENTS 1,093,705 A * 4/1914 Labombarde ..... 229/117.25
2,347,155 A * 4/1944 Leahey ..... 40/312
2,365,887 A * 12/1944 Lind ..... 229/117.12
2,711,541 A * 6/1955 Bellett ..... 2/206
2,714,448 A * 8/1955 Brown ..... 206/216
2,748,527 A * 6/1956 Seals ..... 446/71
2,805,516 A * 9/1957 Palm ..... 446/79
2,811,807 A * 11/1957 Swann ..... 446/73
2,867,372 A * 1/1959 Fox ..... 383/200
2,950,040 A * 8/1960 Bolding ..... 229/118
3,031,121 A * 4/1962 Chase ..... 383/13
3,183,614 A * 5/1965 Loderhose ..... 229/155
3,220,634 A * 11/1965 Rubinstein ..... 206/459.5
3,335,937 A * 8/1967 Kramer ..... 229/118
3,389,850 A * 6/1968 Rockefeller ..... 229/102
3,747,264 A * 7/1973 Brandwein ..... 446/329
3,804,323 A * 4/1974 Bemel ..... 383/40
3,861,279 A * 1/1975 Maling ..... 493/343
3,995,388 A * 12/1976 Penick et al. ..... 40/530
4,326,356 A * 4/1982 Mason ..... 446/73
4,417,609 A * 11/1983 Sherwood ..... 141/98
4,548,352 A * 10/1985 Capo et al. ..... 229/116.1
4,558,528 A * 12/1985 Cunningham ..... 40/365
4,648,548 A * 3/1987 Shin ..... 229/116.4

(Continued)

*Primary Examiner* — Hemant M Desai
*Assistant Examiner* — Gloria R Weeks
(74) *Attorney, Agent, or Firm* — Christine Flanagan

(57) ABSTRACT

Gift bags with removable, configurable and wearable parts and components have multiple interconnected panels which include a bottom panel and multiple interconnected generally vertically oriented side panels which together form a bag or container with an interior volume which is accessible through an opening. Incorporated into or attached to one or more of the side panels or bottom panel are detatchable articles or components, structures or objects which fit with one or more of the side panels. Any of the side panels may be configured in a manner which is both structural and functional as part of the bag enclosure, and aesthetic, ornamental or decorative and multi-dimensionally and graphically. The removable components may form part or all of any of the aesthetic, ornamental or decorative features of any of the side panels.

10 Claims, 4 Drawing Sheets

(56) References Cited

U.S. PATENT DOCUMENTS

| | | | | | |
|---|---|---|---|---|---|
| 4,676,394 | A | * | 6/1987 | Hiersteiner | 229/117.34 |
| 4,712,673 | A | * | 12/1987 | Moore | 206/232 |
| 4,784,314 | A | * | 11/1988 | Penick | 229/116.3 |
| 4,872,555 | A | * | 10/1989 | Shadrach, III et al. | 206/459.5 |
| 4,887,717 | A | * | 12/1989 | Secrest, Jr. | 206/575 |
| 4,909,636 | A | * | 3/1990 | De Matteis et al. | 383/8 |
| 4,953,779 | A | | 9/1990 | Densen | |
| 5,001,853 | A | | 3/1991 | Odien | |
| 5,035,515 | A | * | 7/1991 | Crossman et al. | 383/38 |
| 5,156,266 | A | * | 10/1992 | Sykora | 206/216 |
| 5,163,756 | A | * | 11/1992 | Riseman | 383/127 |
| 5,207,328 | A | * | 5/1993 | Bose et al. | 206/554 |
| 5,246,161 | A | * | 9/1993 | Kapp | 229/103 |
| 5,251,808 | A | * | 10/1993 | Rudd | 229/101.2 |
| 5,361,905 | A | * | 11/1994 | McQueeny et al. | 206/494 |
| 5,363,955 | A | * | 11/1994 | Fleenor | 206/273 |
| 5,441,348 | A | * | 8/1995 | Valentino | 383/127 |
| 5,458,521 | A | * | 10/1995 | Todd | 446/73 |
| 5,613,312 | A | * | 3/1997 | Crowell | 40/312 |
| 5,636,782 | A | * | 6/1997 | Moore | 229/71 |
| 5,682,999 | A | * | 11/1997 | Larson | 206/768 |
| 5,697,549 | A | * | 12/1997 | Yocum | 229/400 |
| 5,702,038 | A | * | 12/1997 | Miller et al. | 224/409 |
| 5,836,095 | A | | 11/1998 | Crowell | |
| 5,894,947 | A | * | 4/1999 | Morano | 215/11.3 |
| 5,938,014 | A | * | 8/1999 | Wilkinson | 206/216 |
| 5,979,745 | A | * | 11/1999 | Surlina | 229/106 |
| 6,000,849 | A | * | 12/1999 | Keller et al. | 383/80 |
| 6,146,018 | A | * | 11/2000 | Keller et al. | 383/78 |
| 6,206,570 | B1 | * | 3/2001 | Cortopassi | 383/127 |
| 6,209,780 | B1 | * | 4/2001 | Jensen | 229/103 |
| 6,213,642 | B1 | * | 4/2001 | Jensen | 383/127 |
| 6,227,707 | B1 | * | 5/2001 | Anderson | 383/127 |
| 6,299,352 | B1 | | 10/2001 | Julien | |
| 6,345,912 | B1 | * | 2/2002 | Ho | 383/20 |
| D461,956 | S | | 8/2002 | Andrew | |
| 6,485,801 | B1 | * | 11/2002 | Chen | 428/28 |
| 6,749,064 | B1 | | 6/2004 | Alrey | |
| D493,829 | S | | 8/2004 | Foster | |
| D494,853 | S | | 8/2004 | Chan | |
| 7,222,446 | B2 | | 5/2007 | Foster | |
| D547,673 | S | | 7/2007 | Glass | |
| D548,107 | S | | 8/2007 | Glass | |
| 7,317,573 | B2 | * | 1/2008 | Billen | 359/474 |
| 7,475,804 | B2 | * | 1/2009 | Clegg et al. | 229/116.1 |
| 7,587,883 | B2 | * | 9/2009 | Cook et al. | 53/491 |
| 7,608,317 | B2 | * | 10/2009 | Keckeisen et al. | 428/136 |
| 7,748,528 | B2 | * | 7/2010 | Anderson | 206/326 |
| 7,883,004 | B2 | * | 2/2011 | Halbur et al. | 235/379 |
| D642,623 | S | * | 8/2011 | Turner et al. | D20/40 |
| 2004/0094610 | A1 | * | 5/2004 | Longo | 229/116.1 |
| 2004/0112782 | A1 | * | 6/2004 | Au | 206/457 |
| 2006/0124494 | A1 | * | 6/2006 | Clark et al. | 206/440 |
| 2006/0219764 | A1 | * | 10/2006 | Copeman | 229/116.1 |
| 2007/0007167 | A1 | * | 1/2007 | Petter | 206/768 |
| 2007/0138248 | A1 | * | 6/2007 | Wallen et al. | 229/243 |
| 2009/0050505 | A1 | * | 2/2009 | Rubin | 206/459.5 |
| 2009/0212096 | A1 | * | 8/2009 | Sieber et al. | 229/116.1 |
| 2010/0213098 | A1 | * | 8/2010 | Tomasello et al. | 206/575 |
| 2010/0230306 | A1 | * | 9/2010 | Dana | 206/308.1 |

* cited by examiner

GIFT BAGS WITH REMOVABLE, CONFIGURABLE AND WEARABLE PARTS

FIELD OF THE INVENTION

The invention relates to construction for gift holding systems and, more particularly, to unique holding systems constructions which incorporate highly visible, visually distinctive indicia associated therewith for adding excitement and interest to the holding system.

BACKGROUND OF THE INVENTION

Gift bags are widely used as decorative and fanciful carriers and packaging for gifts of all types and for all ages of recipients. One of the advantages of conventional gift bags is that exterior can be made attractive by a wide variety of printing and materials and ornamentation appropriate for different occasions and different recipients. Many gift bags are thus decorated to be event or recipient specific. The can be a wide variety of printed design and adornment. Gift bags can also be made quite durable so that they can be re-used from occasion to occasion. has become increasingly popular for gifts. Typically, gifts are placed in brightly colored bags which make the occasion festive. In spite of the bags increased popularity, the construction of the bag has not changed from conventional bags, which includes a front panel and a rear panel connected with two side panels, with the side panels constructed for folding to enable the bag to be stored flat until use. In addition, handle members are also often incorporated on the front and rear panels for assisting in holding the bag along with its contents.

SUMMARY OF THE INVENTION

The present disclosure and inventions include gift bags with removable components which can be used as adornments, props, accessories and articles of clothing. In a representative embodiment, a gift bag is formed by multiple interconnected panels which include a bottom panel and multiple interconnected generally vertically oriented side panels which together form a bag or container with an interior volume which is accessible through an opening, for example between or within the side panels. Incorporated into or attached to one or more of the side panels or bottom panel are articles or components, structures or objects which fit with one or more of the side panels. The articles, components, structures or objects are detachable from the one or more side panels. Any of the side panels may be configured in a manner which is both structural and functional as part of the bag enclosure, and aesthetic, ornamental or decorative and multidimensionally and graphically. The removable components may form part or all of any of the aesthetic, ornamental or decorative features of any of the side panels. The removable components are preferably secured to or made integral with any of the side panels by structures, devices or materials by which the components are both structural; aesthetic, decorative or ornamental, yet also relatively easily detachable. The removable or detachable components may be constructed of any material in any form or configuration or shape. In one embodiment, the removable components are of the same material as one or more of the panels of the gift bag. In other embodiments, a removable component or components may be affixed, adhered or attached to a surface of one of the panels of the bag. Multiple removable components associated with a single bag may be attached to and removed from different panels or areas of the bag and together provide a complimentary ensemble. Multiple removable components of one bag may share design attributes or themes with each other and with the bag in its entirety.

DETAILED DESCRIPTION OF PREFERRED AND ALTERNATE EMBODIMENTS

Figure 1:
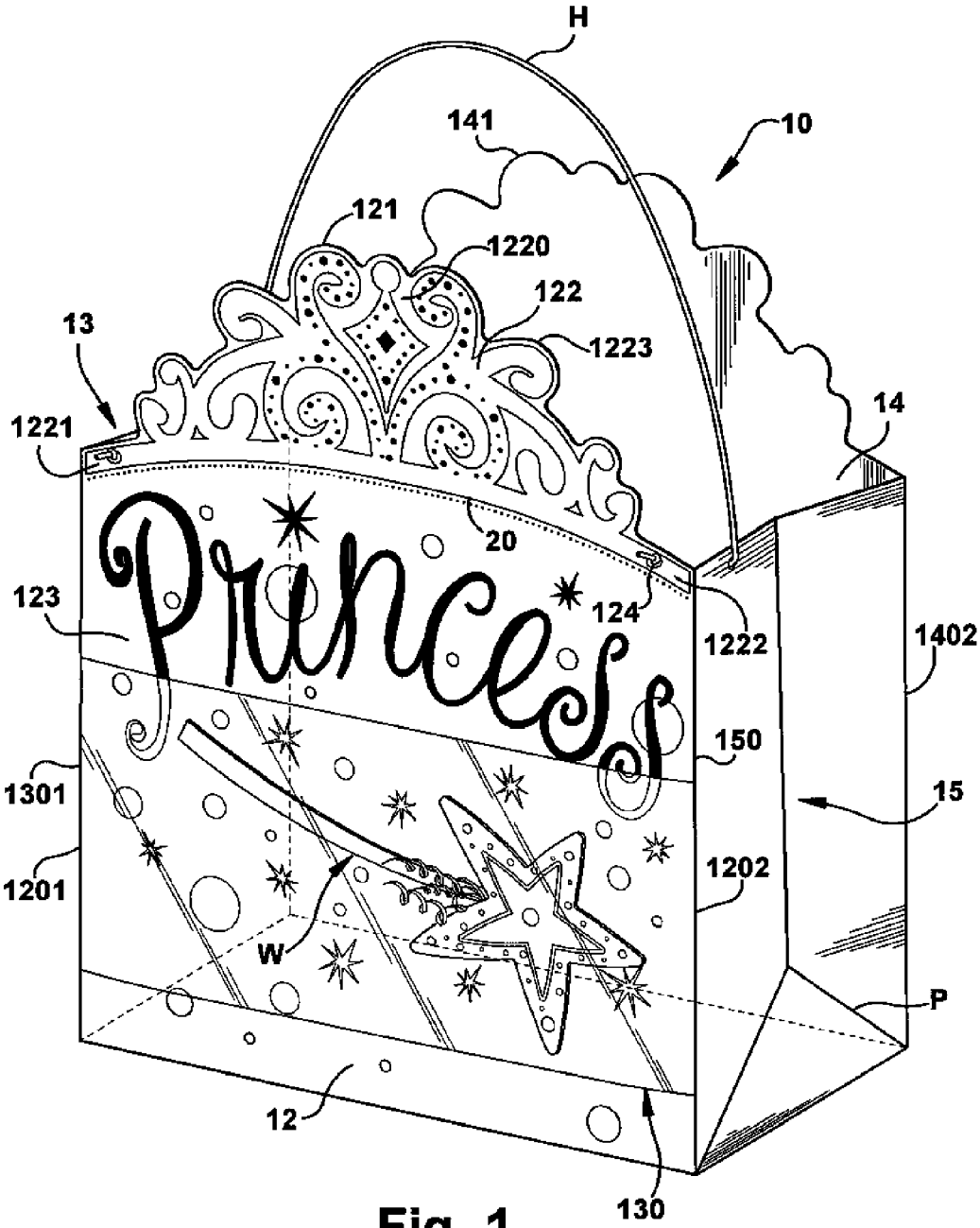
FIG. 1 is a perspective view of a gift bag of the present disclosure and related inventions.
Figure 2:
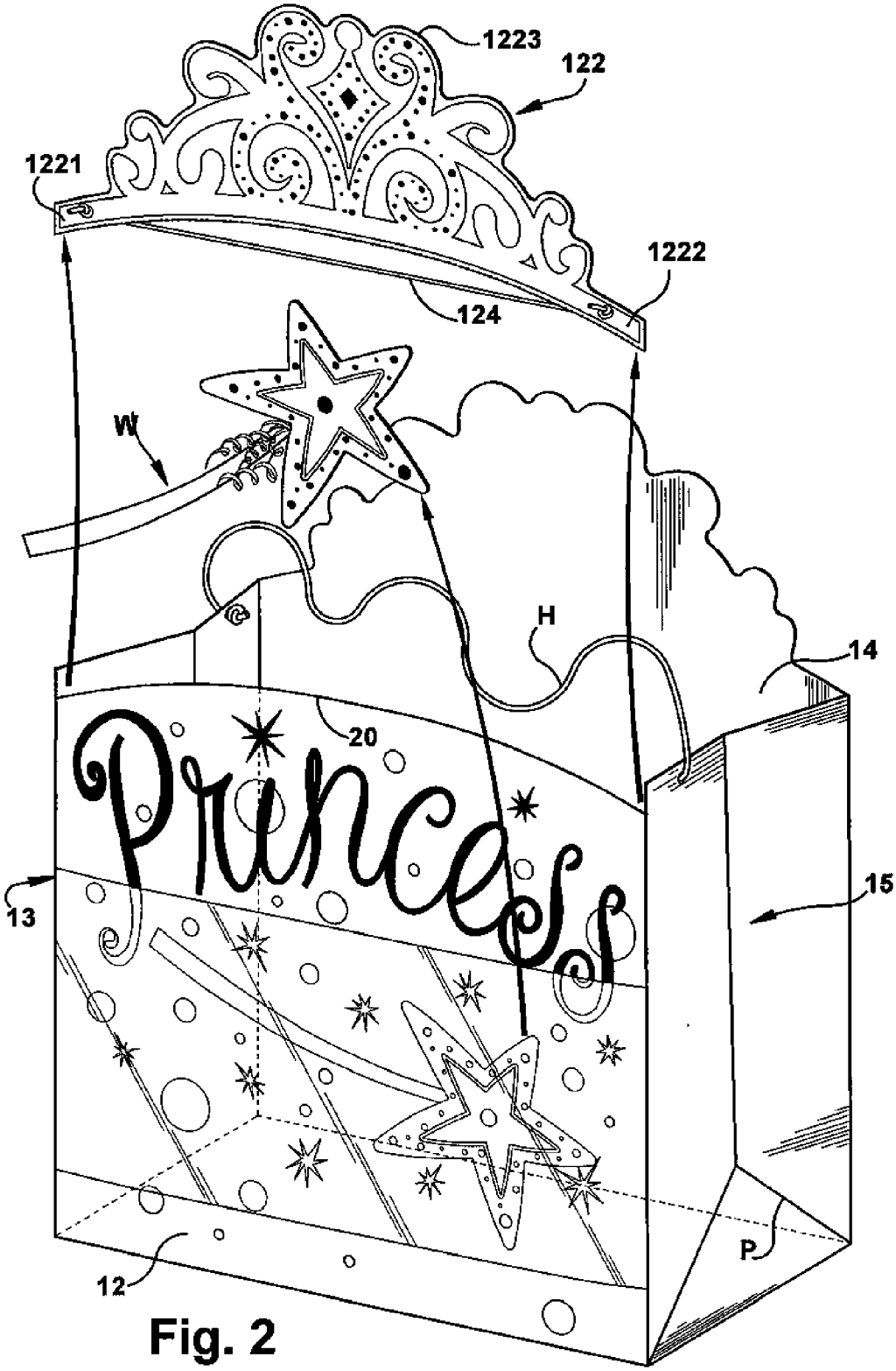
FIG. 2 is a perspective assembly view of the gift bag of FIG. 1.

As shown in FIGS. 1 and 2, a gift bag, indicated in its entirety at 10, has the general construction of a pleated container with first and second main opposing walls 12 and 14 (also referred to as "panels" and "main panels"), opposing side walls or panels 13 and 15, with pleats P, and a bottom 16 (or "bottom panel") to which the lower edges of the four interconnected side walls or panels are attached. Each main panel 12, 14 has first and second edges 1201, 1202 and 1401, 1402. The first and second edges 1201 and 1202 or main panel 12 are attached to first edges 1301 and 1501 of the side panels 13 and 15. The first and second edges 1401 and 1402 of main panel 14 are attached to second edges 1302 and 1502 of the side panels 13 and 15. A handle H, or other carrying structure or device, can be mounted to one or more panels of the bag as shown. One or more of the panels of the bag may be formed with a non-linear profile or edge, such as edges 121 and 141 along the top of respective panels 12 and 14. These profiles or edges may be made in any form or shape, and can be die cut or laser cut in the same or different patterns for each panel. The top edges of the opposing side walls 13 and 15 may also be formed with fanciful or non-linear forms.

As further shown in FIGS. 1 and 2, at least one of the panels, such as panel 12, is formed with a frangible line or perforation 20 which renders an upper portion 122 of the panel separable from a lower portion 123 along the perforation 20. The perforation 20 can be located at or near a top edge of the adjoining panels, such as near to the top edges of side walls or panels 13 and 15, or slightly below (as shown) or above.

Figure 3:
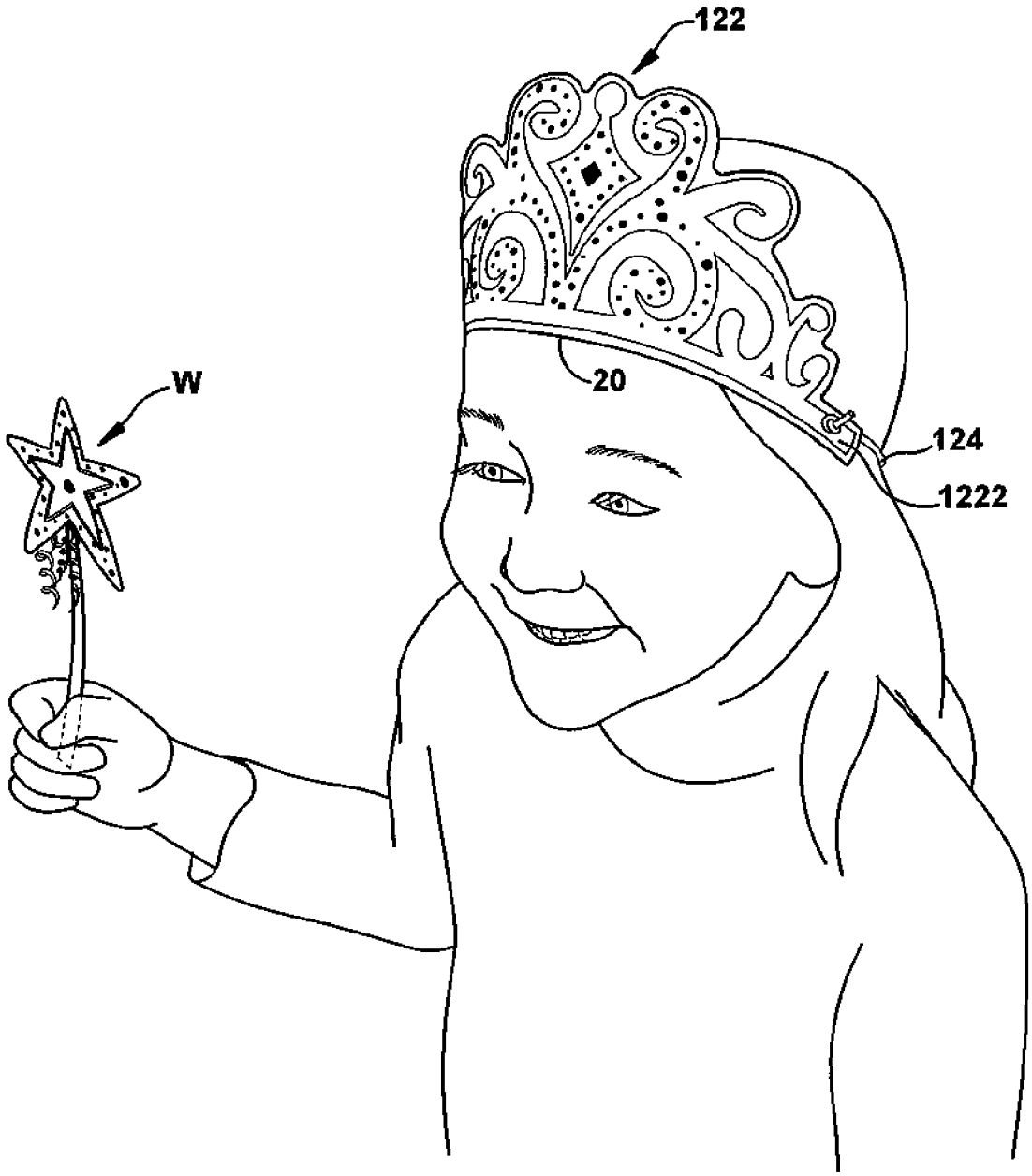
FIG. 3 is a perspective view of component parts of the gift bag of FIG. 1 in exemplary use.

FIG. 2 illustrates the upper portion 122 of panel 12 removed from the lower portion 123 along perforation 20. In this particular embodiment, the upper portion 122 is in the general configuration of a crown, such as a head crown, which can be worn over the head, e.g. over the forehead, by use of a band 124 which is secured to opposite ends of the upper portion 122. The upper portion 122 is a removable and configurable article which is a part of the panel 12 of the bag, and which can be removed from panel 12 of the bag as further described. The upper portion 122 has a main body section 1220 and laterally extending arms 1221 and 1222 each of which extends laterally from the main body section 1220 and to the respective side walls 13 and 15. The upper portion 122 also has a top profile 1223 which extends above the top edges of the main panels 12 and 14 and side panels 13 and 15, and which in this particular embodiment is multi-directional and curvilinear. The band 124 can be made of elastic material and attached to the upper portion 122 at points on the laterally extending arms 1221 and 1222. The elastic band 124 can be attached to the upper portion 124 prior to separation from lower portion 123, and reside substantially within the interior of the bag, with the ends tied through the laterally extending arms 1221 and 1222 as shown. In use, the recipient of the gift bag can remove and wear the upper portion 122, as shown in FIG. 3. The gift bag 10 thus provides an interactive entertainment product in addition to gift carriage and decoration.

Other structural, ornamental and interactive features may be incorporated into the construction of the gift bag 10, such as a pocket 130 formed on one of the main walls 12, 14, which may be partially or entirely transparent, and dimensioned to hold one or more objects, or at least one additional article, such as for example the illustrated wand W, or any other object or shape, which can be removed from the pocket and used as a utilitarian and entertainment object (as shown in FIG. 3), and which may have a configuration which corresponds to the configuration of the removable and configurable article, and which may compliment the theme or character of the separated upper portion 122 of panel or wall 12. As illustrated, any of the walls or panels of the bag may be printed or otherwise decorated or adorned. In particular, printing on a panel such as panel 12 with removable upper portion 122 may be coordinated with and within the boundaries of the upper portion 122, and coordinated with the frangible line or perforation 20.

Figure 5:
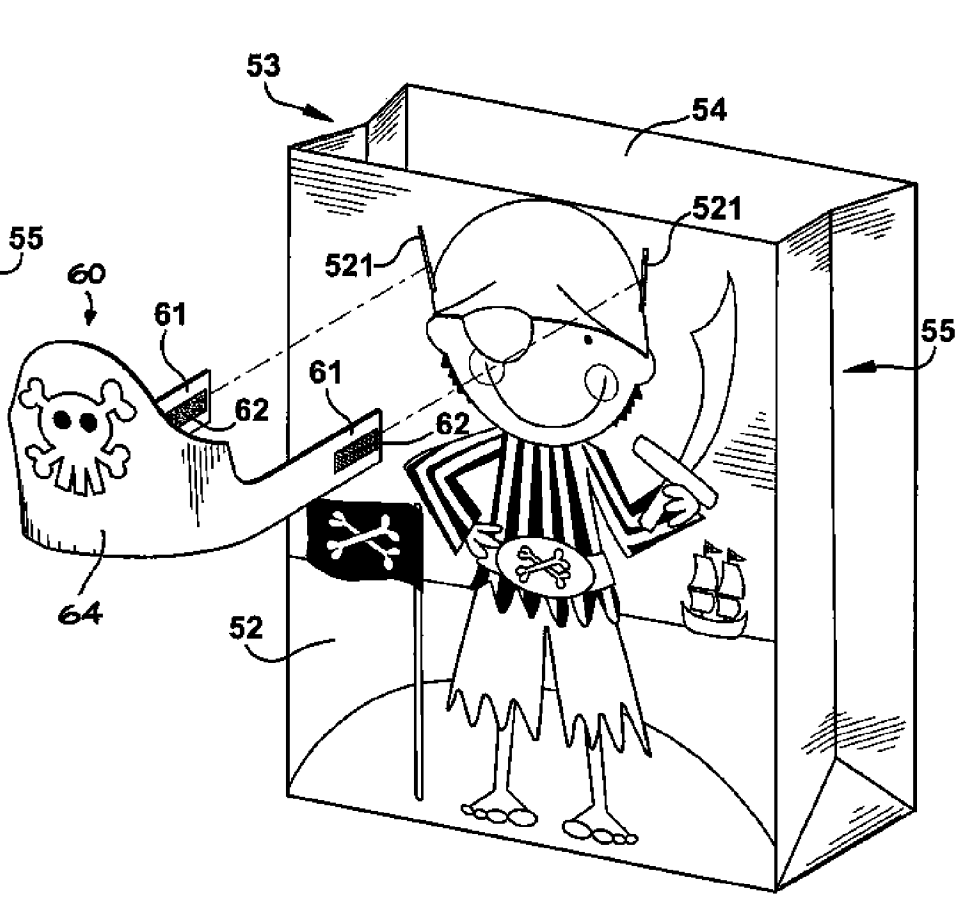
FIG. 5 is a perspective assembly view of the gift bag of FIG. 4.
Figure 4:
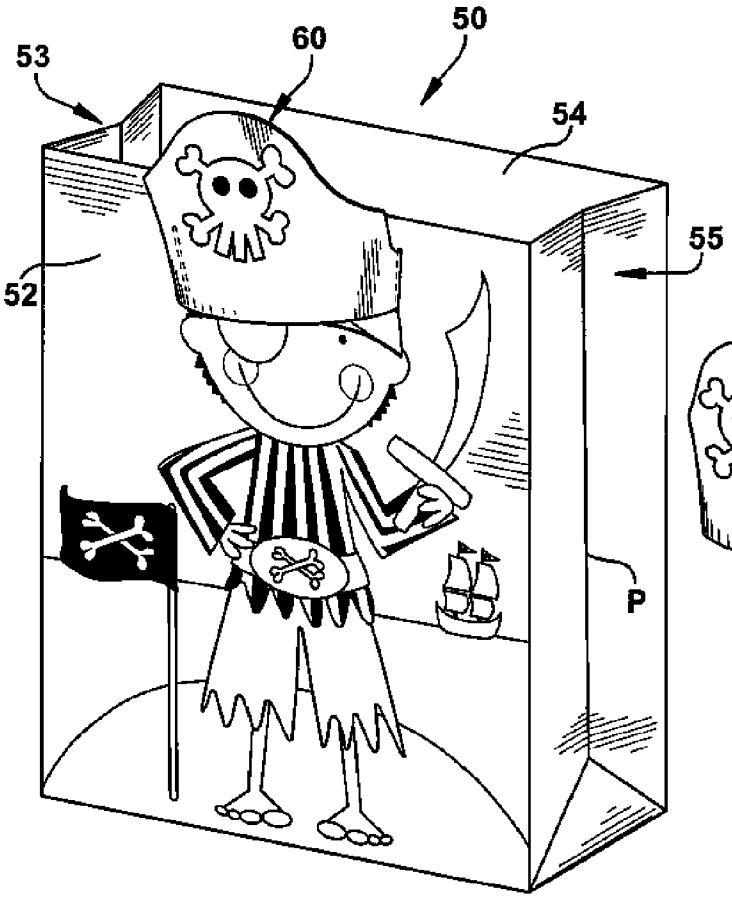
FIG. 4 is perspective view of an alternate embodiment of a gift bag of the present disclosure.

An alternate embodiment of a gift bag with at least one removable and wearable part is illustrated by FIGS. 4 and 5. In this particular embodiment, a bag generally indicated at 50 and which can be used as a gift bag for holding and presenting one or more gifts, has similar general construction and configuration of main opposing walls or panels 52 and 54, opposing side walls or panels 53, 55, which may be pleated along folded pleats P, with bottom edges of each of the walls or panels contiguous with a bottom panel which forms the bottom of the bag. A removable article 60 is engaged with one of the walls or panels of the bag, such as panel 52 as shown, by extension through slots or openings 521 which are formed in the panel 52. The removable article 60 may be configured with a main center section 64 and extensions or arms 61 which extend therefrom and fit with and through openings 521 to extend into the interior of the bag. Fasteners 62, such as removable fasteners such as Velcro, snaps or adhesive, are located on the distal ends of arms 61 operate to secure the arms 61 together within the bag, at a location within an interior of the bag, and to thereby secure the article 60 with the bag. The shape, theme, decoration or configuration of the removable article 60 may be complimentary to the theme, decoration, printed matter or graphics or other articles of the bag 50, such as the illustrated example of a piece of headwear which fits on panel 53 as headwear for the graphically depicted pirate. The article 60 can then be removed by the recipient from the bag, by operation of fasteners 62 and physically used as headwear. The removable article 60 can be made of any suitable material, including but not limited to paper, paperboard, fabric, polymer, foam or fiber or combinations thereof.

What is claimed as the invention is:

1. A gift bag in combination with a removable and configurable article which is attached to and removable from the gift bag, the removable article being configurable to be worn as an article of clothing or decoration, the gift bag and removable article combination comprising:

a decorative gift bag having a first main panel, a second main panel which is parallel to and spaced apart from the first main panel, a right side panel and a left side panel which extend vertically between the first and second main panels and an end panel which forms a bottom or closed end of the gift bag, the opposite end being completely open for insertion of an article, the first and second main panels each having a larger surface area than each of the right and left side panels;

the first or second main panel having a removable upper portion located along the open end of the gift bag which can be removed from the gift bag and configured as an article of clothing or decoration, the removable upper portion attached only to the first or second main panel and only along a single horizontal frangible line which extends across an entire width of the first or second main panel between the left and right side panels, the removable upper portion being equal in height to the opposite main panel but extending in height above the right and left side panels and being removable from the first or second main panel by separation from the first or second main panel along the single horizontal frangible line thereby decreasing the length of the first or second main panel to a length which is approximately the same height as the left and right side panels and maintaining the integrity of the gift bag, and;

an elastic band attached at two points to the removable upper portion, the elastic band located within an interior of the gift bag when the removable upper portion is attached to the first or second main panel of the gift bag, and a handle which extends from the right side panel to the left side panel proximate to the open end of the bag.

2. The gift bag of claim 1, wherein the removable and configurable article is in the form of headwear which is configurable to be worn on the head after removal from the first or second main panel of the gift bag by separation along the single horizontal frangible line.

3. The gift bag of claim 2, wherein the first or second main panel of the gift bag has a top edge located at the open end of the gift bag which generally conforms to a non-linear edge of the removable and configurable article formed by the removable upper portion of an opposite main panel.

4. The gift bag of claim 1 further comprising a pocket attached to the first or second main panel, and at least one additional article which is removable from the pocket and which has a configuration which corresponds in theme to a configuration of the removable and configurable article.

5. The gift bag of claim 4, wherein the pocket is made of transparent material, and the at least one additional article is visible within the pocket and positioned closely proximate to the first or second main panel of the gift bag.

6. A gift bag comprising:

a gift giving container having two main panels parallel and spaced apart from each other and adjoined by two side panels, and a bottom panel which forms a closed end of the container the opposite end of the container being open;

wherein the two main panels are both structural and functional as a part of the receptacle and are also ornamental and decorative as part of a gift giving container;

a removable section being removably attached along a single frangible line to one of the two main panels, the removable section configured to be worn atop or around a user's head as a crown or tiara;

an elastic band attached to each distal end of the removable section for securing the removable section to the user's head.

7. The gift bag of claim 6 further comprising a handle attached at one end to a first side panel and at the opposite end to a second side panel.

8. The gift bag of claim 6, wherein the upper portion of the two main panels are decorated identically.

9. The gift bag of claim 6, wherein the removable portion is configured to form an arcuate shape upon removal from the first or second main panel.

10. The gift bag of claim 6, wherein the integrity of the gift bag remains intact after the removable section is removed from the gift bag.

* * * * *